US006135081A

United States Patent [19]

Eidenboeck et al.

[11] Patent Number: 6,135,081

[45] Date of Patent: Oct. 24, 2000

[54] ENGINE POWER SECTION FOR PISTON ENGINES, PARTICULARLY V-ENGINES

[75] Inventors: Thomas Eidenboeck; Franz Malischew, both of Steyr, Austria; Klaus Eigenfeld, Freiberg/Sachsen; Horst Henkel, Friedensdorf, both of Germany

[73] Assignees: Bayerische Motoren Werke AG, Munich; Fritz Winter Eisengiesserei GmbH & Co. KG, Stadtallendorf, both of Germany

[21] Appl. No.: 09/142,451

[22] PCT Filed: Feb. 14, 1997

[86] PCT No.: PCT/EP97/00696

§ 371 Date: Dec. 29, 1998

§ 102(e) Date: Dec. 29, 1998

[87] PCT Pub. No.: WO97/33084

PCT Pub. Date: Sep. 12, 1997

[30] Foreign Application Priority Data

Mar. 7, 1996 [DE] Germany ..... 196 08 877

[51] Int. Cl.[7] ..... F02F 7/00

[52] U.S. Cl. ..... 123/195 R; 123/195 A; 123/195 AC; 123/195 H

[58] Field of Search ..... 123/195 A, 195 AC, 123/195 H, 195 S, 41.84, 193.2

[56] References Cited

U.S. PATENT DOCUMENTS

| | | | |
|---|---|---|---|
| 2,078,056 | 4/1937 | Chapman | 123/195 R |

FOREIGN PATENT DOCUMENTS

| | | | |
|---|---|---|---|
| 0 473 006 | 3/1992 | European Pat. Off. . | |
| 0 554 575 | 8/1993 | European Pat. Off. . | |
| 2 381 910 | 9/1978 | France . | |
| 24 32 569 | 1/1976 | Germany | 123/195 R |
| 85 30 709 | 10/1989 | Germany . | |
| 43 24 609 | 1/1995 | Germany . | |
| 58-65955 | 4/1983 | Japan | 123/193.2 |
| 60-81451 | 5/1985 | Japan | 123/193.2 |

*Primary Examiner*—Erick Solis
*Assistant Examiner*—Brian Hairston
*Attorney, Agent, or Firm*—Evenson, McKeown, Edwards & Lenahan, P.L.L.C.

[57] ABSTRACT

An engine power section for piston engines, particularly V-engines, having a power unit block made of an iron material arranged in a casing of light metal. In order to achieve a stiff weight-reducing power unit block, a flange plate used for limiting the crank space as well as for the connection with the casing is arranged offset relative to a cylinder from its lower end toward its upper end with its front side surface center of gravity at a distance on this side of the bearing center plane of a crankshaft bearing, which corresponds at least to a largest possible distance of the surface center of gravity of a reinforcing profile of a bearing frame on the other side of the bearing center plane. The crankshaft bearings are connected with the flange plate by way of struts.

14 Claims, 2 Drawing Sheets

ENGINE POWER SECTION FOR PISTON ENGINES, PARTICULARLY V-ENGINES

BACKGROUND AND SUMMARY OF THE INVENTION

The invention relates to an engine power section for piston engines, particularly V-engines.

For reducing the weight of an engine power section, it is basically known to manufacture the power unit block, which is highly loaded and is essentially formed of the cylinders with directly or indirectly shaped-on crankshaft bearings, preferably of an iron material, and to construct the less loaded power section walls separately of a lighter material or one which is manufactured with a particularly thin wall.

One example of this construction principle for the engine power section of a liquid-cooled internal-combustion engine is known from British Patent Document GB-PS 678 903, in which case the power section walls adjoining the crank space as well as the power section walls used for covering the cylinder coolant spaces are made of metal sheets. In contrast, for achieving the required stability, the power unit block has a relatively massive construction with end-side front walls between the cover plates and base plates of the cylinders, heavy bearing blocks being arranged in one piece on the base plate.

Disadvantages of this known engine power section and of the engine power section known from British Patent Document GB-PS 695 972 are in each case a moderate weight reduction as well as corrosion and sealing problems, particularly in the connection points of the structural components made of different materials. In addition, there are problems concerning acoustics.

For reducing particularly the acoustic problems, an engine power section for a liquid-cooled internal-combustion engine is known from U.S. Pat. No. 4,446,827 which comprises a power unit block which has a massive design corresponding to the above-mentioned British Patent Document GB-PS 678 903, to which separate power section walls are assigned which are made of a very sound-absorbing material, such as rubber, plastic or resin.

According to German Registered Utility Patent DE-U 94 12 637, corrosion and sealing problems for an engine power section of a liquid-cooled internal-combustion engine designed of different materials is avoided in that a light-metal power section is poured around a power unit block made of gray cast iron, the coolant spaces being constructed exclusively in the light metal power section. A disadvantage in this case is the massive design of the power unit block with engine baseboards arranged on the crankshaft bearing blocks by way of web-type supports, which baseboards are connected with the light metal power section in a material-locking manner in the oil pan connection area of the light metal power section. This heavy design results in another disadvantage in that these engine baseboards connected in a material-locking manner with the bearing blocks act as structure-borne noise bridges and acoustically excite at least the crank space covers of the light metal power section which are connected with them in a material-locking manner.

Further, from European Patent Document EP-A 0 554 575, which was published before German Patent Document DE-U 94 12 637, an engine power section for a liquid-cooled internal-combustion engine is known in the case of which a power unit block also made of gray cast iron is cast into a light metal power section. For reducing the weight of the power unit block, cylinders arranged in a row are arranged in a material-locking adjacent manner and carry massively designed bearing blocks arranged by way of spaced flat webs in the connection areas. During the casting into the light metal power section, the flat webs and the bearing blocks are integrated in a material-locking manner in transverse walls connected with the light metal power section. This support of the crankshaft bearings with respect to a crank space power section wall which is designed for reasons of stability and requires high expenditures of material acts as a structure-born sound bridge which acoustically excites the light metal power section.

Finally from Japanese Published Patent Application 4-121 443, a power unit block is known for a liquid-cooled internal-combustion engine which has a shaped-on cylinder head. This design, which is known as a "monoblock", comprises a base plate which is constructed at the lower end of the cylinder bushes and on which, on the one hand, a casing is detachably fastened which surrounds the monoblock and on which, on the other hand, massively constructed crankshaft bearing blocks are arranged whose bearing caps are arranged by way of longitudinal webs in a bearing frame which disadvantageously is designed to require high expenditures of material.

The characteristic which the above-indicated state of the art has in common is the fact that resistance to bending and torsion required for a power unit block is achieved predominantly by way of cylinders which are connected with one another, specifically either by their siamese-type attached arrangement or their arrangement between cover and base flange plates connected in one piece in a material-locking manner which, in addition, are connected by way of front plates.

The above-mentioned type-forming Japanese Published Patent Application 4-121 443 shows a particularly stiff power unit block which, however, is also heavy because of the cylinder head which is provided instead of the cover flange plate and which is arranged in a one-piece material locking manner, which power unit block has a massive bearing frame for the bearing caps of the crankshaft bearings.

It is an object of the invention to provide a light weight power unit block with cylinders which has a high design stability which is insignificantly increased by the cylinders, for a light-weight engine power section.

This object is achieved by arranging the flange plate to be offset relative to the cylinder from its lower end to its upper end with its face-side surface center of gravity at a distance on this side of the bearing center plane of the crankshaft bearings, which corresponds at least to a largest possible distance of the surface center of gravity of a profile of the stiffening element of the bearing frame on the other side of the bearing center plane, the crankshaft bearings being connected by way of struts with the flange plate.

It is the basic idea of the invention to arrange devices of the power unit block arranged in the longitudinal direction of the engine relative to the axis of rotation of the crankshaft at the largest possible distance in a connection or achieving a high moment of inertia and thus a high moment of resistance, in which case the effective distances required for this purpose are, on the one hand, achieved by way of the design of the bearing frame with at least one stiffening element provided particularly low below the crankshaft and, on the other hand, by a flange plate which is advantageously easily arranged to be displaced at a far distance in the direction of the vertical axis of the cylinder or cylinders from the axis of rotation of the crankshaft. As the result of the flange plate integrated according to the invention with the stiffening element of the bearing frame in a connection, the cylinder as the element providing significant stability is eliminated, whereby the cylinder or cylinders can advantageously be constructed to have a thin wall.

In addition, by means of the invention, the piston stroke and the cylinder diameter can be defined without taking into account the design stability of the power unit block, with the advantage that also large-volume, high-power piston engines can be constructed to be relatively low. With the free selection of the largest possible distances of devices pointing in the longitudinal direction of the engine from the plane of the axis of rotation of the crankshaft, the invention offers the advantage with respect to a light construction of the power unit block that these devices (flange plate, stiffening elements) can have a relatively thin-walled design while the stability is high.

Advantageous further developments of the engine power section according to the invention achieve a high design stability of both structural components individually and in a functional connection by means of open and hollow profiles which are connected with one another in a one-piece material-locking manner for the power unit block manufactured preferably of gray cast iron as well as for the casing made of light metal which is in one piece with the power section walls in each case at low expenditures of material.

BRIEF DESCRIPTION OF THE DRAWINGS

The invention will be described by means of a preferred embodiment illustrated in the drawing.

DETAILED DESCRIPTION OF THE DRAWINGS

Figure 1:
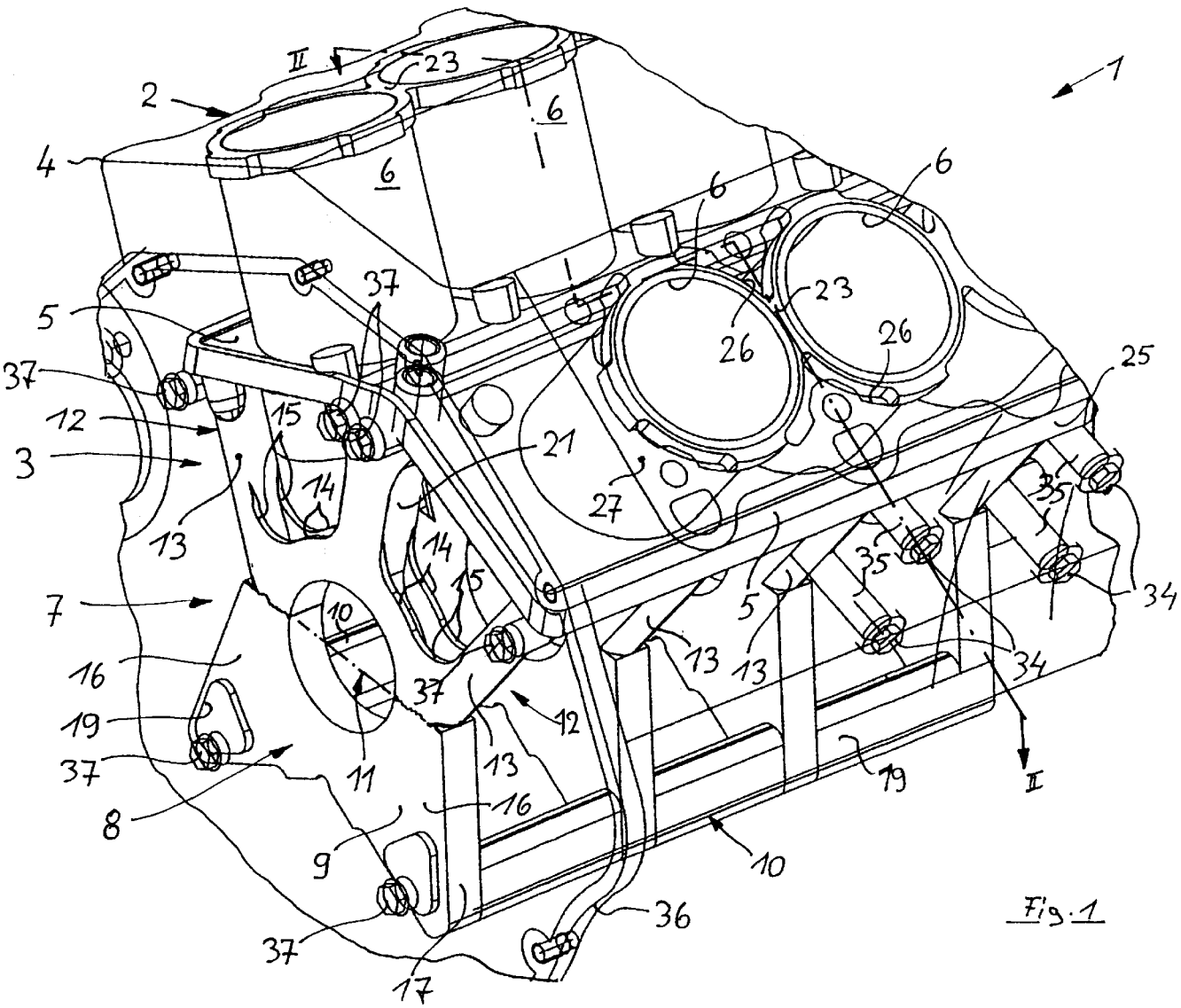
Figure 2:
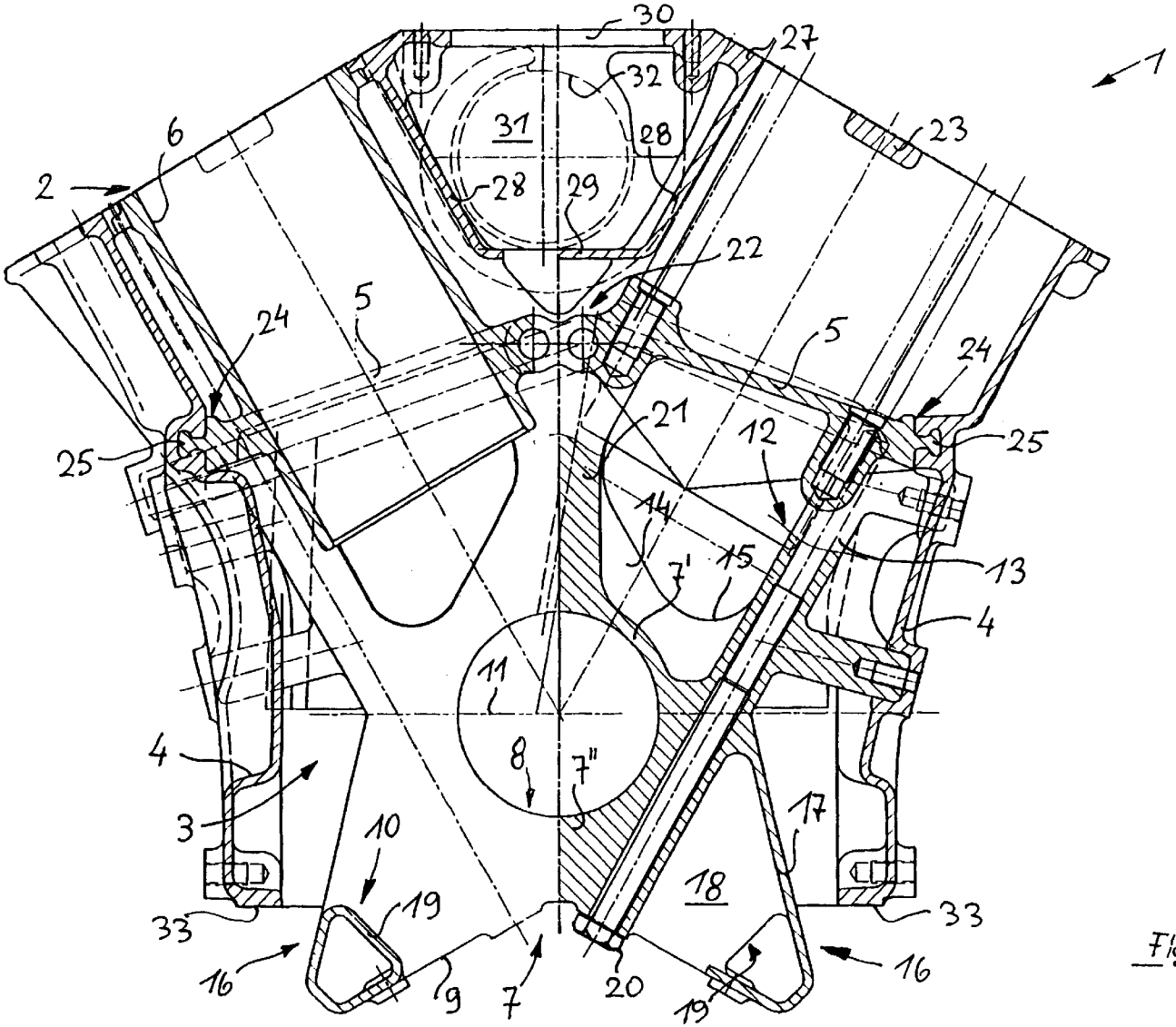

FIG. 1 is a perspective view of a power unit block for a V-engine with a partially shown casing;

FIG. 2 is a cross-sectional view of the power unit block and of the casing according to Line 2—2 in FIG. 1.

An engine power section 1 for a liquid-cooled piston internal-combustion engine 2 designed as a V-engine comprises a power unit block 3 and a casing 4 which is separate from it and is formed in one piece from power section walls and is made of a material which is lighter than that of the power unit block 3. For the connection with the casing 4, the power unit block 3 is equipped with flange plates 5 which are in each case on one side connected with cylinders 6 and on the other side with divided crankshaft bearings 7, their bearing caps 8 being arranged in a bearing frame 9 with stiffening elements 10 pointing in the longitudinal direction of the engine.

For achieving a light-construction power unit block 3 with a high resistance to bending and torsion, according to the invention, the flange plates 5 are arranged to be offset relative to the cylinders 6 from their lower ends to their upper ends with their respective front-side surface centers of gravity at distances on this side of the bearing center plane 11 of the crankshaft bearings 7, these distances corresponding at least to the largest possible distances of the surface centers of gravity of the profiles of the stiffening elements 10 of the bearing frame on the other side of the bearing center plane 11, and the crankshaft bearings 7 being connected by way of struts 12 with the flange plates 5.

The power unit block 3 constructed according to the invention forms a spatial connection whose moments of resistance to bending and torsion are advantageously achieved without an integration of the cylinders 6 essentially by way of the devices of the flange plate 5 which in each case have the largest possible distance from the bearing center plane 11 and point in the longitudinal direction of the engine, in combination with the stiffening elements 10 of the bearing frame 9.

A light weight, while the stability is high, is achieved in another embodiment according to the invention in that the crankshaft bearings 7 are in each case connected, by way of hollow struts 13 arranged on both sides essentially in a transverse plane of the engine, in a one-piece material-locking manner with the flange plates, in which case each bearing block 7', which is preferably constructed in the manner of a half-ring, by means of radial flanges 14, forms a U-profile which is open on the cylinder side or flange plate side, with transitions 15 reinforcing the hollow struts 13 in the connection area.

Further, for the purpose of stability at a low weight, while utilizing an installation space provided by an oil pan which is not shown, it is provided that each bearing cap 7" and 8 has projections which are arranged on the opposite side in the longitudinal direction of the engine in a spaced manner, pointing laterally deep downward relative to the bearing center plane 11, in which case the relatively thin-walled projections 16 by means of coverings 17 form essentially closed hollow profiles 18 which are connected with hollow beams 19 as reinforcing elements 10 which, for matching the projections 16, are constructed in their cross-section to be triangular and thin-walled.

The power unit block 3 is preferably made of vermicular gray cast iron (GGV) in a one-piece, material-locking manner at least in the circumference of the flange plates 5 with the crankshaft bearings 7 arranged by way of the hollow struts 13, including the bearing frame 9. For dividing the crankshaft bearing 7, the bearing frame 9 with the bearing caps 7" is preferably separated by means of a breaking separation from the bearing blocks 7'. For the breaking separation, the process suggested in the German Patent Document P 195 47 389 is used for forming breaking separating notches, particularly in combination with a device suggested in PCT Application PCT/EP 95/00875.

The bearing frame 9, which is separated from the power unit block 3 by means of "cracking", can be connected with the power unit block 3 by means of two studs 20 provided for each crankshaft bearing 7 which can be screwed into the hollow struts 13. The studs 20 which are preferably arranged essentially at a V-angle of the V-engine 2 obliquely penetrate the breaking separation surfaces preferably arranged in the bearing center plane 11, whereby the transverse forces in each crankshaft bearing 7 are securely transmitted by way of the braced breaking separation surface by means of the only two provided studs 20. These reduced screwing expenditures advantageously result in a narrow bearing frame with stiffening elements 10 or hollow beams 19 which can be arranged below the bearing center plane 11.

As illustrated in the figures, the flange plates 5, which are arranged in a roof-type manner, are, along their outer longitudinal areas, connected in a one-piece, material-locking manner with the crankshaft bearings 7 by way of hollow struts 13 arranged in a V-shape corresponding to the studs 20. Between the hollow struts 13, which are advantageously arranged essentially in parallel to the axes of the cylinders 6, the flange plates 5, which are connected in one piece in the center, are connected by way of this connection area with each bearing block 7', in addition, by means of hollow supports 21. These supports 21 are used for diverting force in the vertical axis of the V-engine 2 for avoiding a critical load on the hollow struts 13. For reinforcing the connection area of the flange plates 5, a longitudinal duct 22 is provided which is used, for example, in an interaction with the hollow supports 21 for supplying lubricating oil to the bearings 7.

As addressed above, by means of the invention, a power unit block 3 is achieved without the cylinders 6 as a spatial connection of a high resistance to bending and torsion. Thus, according to the requirements, either insertable cylinders 6 can be selected or cylinders 6 which are fixedly connected with the respective flange plate 5. In the latter case, these penetrate the flange plates 5 preferably obliquely for achieving a stiffer connection between the respective cylinder 6 and the flange plate 5 against operating vibrations which, in addition, in the case of cylinders 6 spaced in rows, are reduced by way of bridges 23 arranged in the direction of the rows between the cylinders 6. In addition, the cylinders 6 stand free in the respective coolant without any pouring of additional material around them.

For a durable connection of the power unit block 3 with the one-piece casing 4, the flange plates 5 have edges 24 in the longitudinal and transverse direction of the engine which are each cambered by means of large radii and which, by way of additional smaller radii, change into one another at the corners of the engine power section. Also, the edges 24 are designed, for example, as flanges 25 with a T-shaped cross-section. As an alternative to the flanges 25, the edges 24 may also have a fracture-type rough surface for the form-locking and force-locking connection with the light-metal casing 4. Furthermore, the flanges 25 may also have a fracture-type rough surface.

By means of this development of the edges 24 on the flange plates 5, a casing 4 made of a light metal casting which is in one piece with outer and inner longitudinal-side as well as front-side power section walls can be assigned to the power unit block 3, in which case, the light-metal casing 4, which during cooling is prevented from shrinking by the flange plates 5 of the power unit block 3, is connected by way of the cambered edges 24 in a uniformly form-locking and force-locking manner with the flanges 25 of the flange plates 5 in a liquid-tight fashion.

The casing 4 is advantageously reinforced in that the cylinders 6, which are connected in a one-piece material-locking manner with the flange plates 5, each end in a cooling space cover plate 27 provided with the cooling openings 26, which cover plate 27 is connected in a one-piece, material-locking manner with the casing 4.

For further reinforcing the casing 4 and thus the engine power section 1, interior longitudinal-side power section walls 28 with base and cover walls 29 and 30 crossing the V-space form a hollow support 31 which reinforces the rows of cylinders 6 and which, as a coolant duct, is connected with a pump housing 32 between valve gear shafts molded on in one piece (FIG. 2).

For achieving a light-construction casing 4, it is also provided that these connection points 34 for auxiliary assemblies and/or bearing supports arranged between an oil pan flange 33 provided in the area of the bearing center plane 11 and the flange connection 25 with the flange plates 5 are connected by way pins 35 arranged on adjacent hollow struts 13 which are preferably used for the arrangement of screwed connection points.

In order to keep higher loads away from the light-metal casing 4, a separate connection flange 36 for a transmission, which is not shown, is assigned to the encased power unit block 3 on the output side, which connection flange 36 can be connected with the power unit block 3 in the center area and in the two outer areas of the flange plate 5 above the output-side crankshaft bearing 7 and can be connected with the bearing frame 9 in the area of the hollow beams 19 below this bearing 7 in each case by way of screwed connections 37.

The weight advantage which can be achieved by means of the invention is particularly important in the case of multi-cylinder piston engines of a V-construction but may also be advantageous for single-bank engines having one or several cylinders.

What is claimed is:

1. Engine power section for piston engines, comprising:

a power unit block which can be connected with a separate cylinder head and which is equipped with separate power section walls of a casing made of a different material, the power unit block comprising a flange plate which carries a cylinder and connects the power section walls as well as divided crankshaft bearings, bearing caps arranged in a bearing frame with at least one engine-longitudinally-directed reinforcing element, struts applied separately from the cylinder to the flange plate by which the crankshaft bearings are connected with the flange plate, the flange plate being constructed as a carrying element for a cylinder and arranged offset away from a lower end toward an upper end thereof such that a largest possible distance of a surface center of gravity of the flange plate, viewed on a face side from a bearing center plane of the crankshaft bearings, is achieved, said largest possible distance corresponding to at least a distance of a surface center of gravity of a profile of the reinforcing element viewed on the face side from the bearing center plane.

2. Engine power section according to claim 1 wherein each bearing is connected in a one-piece material-locking manner with the flange plate by way of hollow struts arranged substantially on both sides in an engine transverse plane, and each bearing block is designed in the manner of a half-ring with radial flanges and forms a U-profile which is open on the flange plate side, with transitions which reinforce the hollow struts at least in sections.

3. Engine power section according to claim 1 wherein each bearing cap has projections which are arranged in a mutually spaced manner relative to the bearing center plane and point laterally downward, and the projections having coverings to form substantially closed hollow profiles which are connected with hollow beams as reinforcing elements which have a substantially triangular cross-section and a thin-walled construction.

4. Engine power section according to claim 1 wherein the flange plate with the crankshaft bearings arranged by way of the hollow struts, including the bearing frame, are constructed in one piece of gray cast iron, and the bearing frame with the bearing caps is separated from the bearing blocks by a breaking separation, and can be connected with the power unit block via two studs which are provided for each crankshaft bearing and can be screwed into the hollow struts.

5. Engine power section according to claim 1 wherein, in the case of a V-engine, flange plates, which are arranged in the manner of a roof, are connected in one piece in the center, and are connected by way of this connection area via hollow supports with each bearing block, and wherein each crankshaft bearing is connected in a one-piece material-locking manner by way of two hollow struts arranged in a V-shape in an engine transverse plane with outer longitudinal areas close to the flange of the flange plates.

6. Engine power section according to claim 5, wherein the flange plates are connected in the center by way of a longitudinal duct, which interacting with the hollow supports, is used for supplying lubricating oil to the crankshaft bearings.

7. Engine power section according to claim 5, wherein the flange plates, which are arranged in the manner of a roof, are each obliquely penetrated by the respective cylinders of each bank and are connected with these in a one-piece material-locking manner, and wherein the cylinders which are mutually spaced in a row are connected with one another by way of bridges arranged in the direction of the row.

8. Engine power section according to claim 5, wherein the connected flange plates have edges which are each cambered by means of large radii in the longitudinal and transverse direction of the engine, which edges are connected to the engine power section corners by way of additional radii, the edges being designed as flanges with a T-shaped cross-section.

9. Engine power section according to claim 8, wherein the connection surfaces of at least one of the edges and of the flanges of the flange plates with the light-metal casing have a fracture-type rough surface.

10. Engine power section according to claim 5, wherein the casing is in one piece with outer and inner longitudinal-side and front-side power section walls and is made of light metal is in a form-locking and force-locking liquid-tight connection with the flanges of the flange plates by a casting process, and wherein the cylinders arranged in the flange plates each end in a cooling space cover plate which may be provided with coolant openings and is in a one-piece material-locking manner connected with the light metal casing.

11. Engine power section according to claim 5, wherein the inner longitudinal-side power section walls with the base and cover walls crossing the V-space form a hollow support which reinforces the banks of the cylinders and which, as a coolant duct, is connected with a pump housing arranged on the front side between valve gear shafts molded on in one piece.

12. Engine power section according to claim 5, wherein, on the casing, connection points for at least one of auxiliary assemblies and bearing supports provided between an oil pan flange provided in the area of the bearing center plane and the flange connection with the flange plates are connected by way of pins arranged on adjacent hollow struts.

13. Engine power section according to claim 5, wherein a separate connection flange is assigned to the encased power unit block on an output side and can be connected in the center area and in both outer areas of the flange plates above an output-side crankshaft bearing and with the bearing frame in the area of the hollow beams below the output-side crankshaft bearing in each case by way of screwed connections with the power unit block.

14. Engine power section according to claim 5, wherein the cylinders, arranged on their circumferences in each case without being surrounded by poured additional material, are acted upon by a coolant of the piston internal-combustion engine.

* * * * *